US005294153A

United States Patent [19]

Nolan

[11] Patent Number: 5,294,153

[45] Date of Patent: Mar. 15, 1994

[54] RIDING TOY FOR CHILDREN

[75] Inventor: Robert J. Nolan, Columbus, Miss.

[73] Assignee: Flexible Flyer Acquisition Corp., Olney, Ill.

[21] Appl. No.: 9,890

[22] Filed: Jan. 27, 1993

[51] Int. Cl.[5] ..... A63H 17/00

[52] U.S. Cl. ..... 280/827; 296/177; 296/35.3

[58] Field of Search ..... 280/827, 828, 87.021, 280/87.01; 296/177, 35.3, 35.1, 36

[56] References Cited

U.S. PATENT DOCUMENTS

| | | | |
|---|---|---|---|
| 3,940,179 | 2/1976 | McBride | 296/36 |
| 4,067,601 | 1/1978 | Tuerk | 296/36 |
| 4,709,958 | 12/1987 | Harrod | 296/177 |
| 4,737,055 | 4/1988 | Scully | 296/35.3 |

*Primary Examiner*—Margaret A. Focarino
*Assistant Examiner*—Kevin Hurley
*Attorney, Agent, or Firm*—Renner, Kenner, Greive, Bobak, Taylor & Weber

[57] ABSTRACT

A riding toy for children has a chassis, a pair of side walls, lateral roof supports and wheel supports. The chassis includes locating protuberances and securement apertures which cooperate with side wall recesses and darts, respectively, to secure the side walls thereto. The roof supports have apertures formed therein which cooperate with roof darts on the side walls to establish a rigid construction of the chassis, side walls and roof supports. The chassis also has seat portions and axle tie bars interconnecting side rails. A front axle tie bar has vertical axle support guides which provide steerable supports for the front axles.

11 Claims, 10 Drawing Sheets

FIG. 5
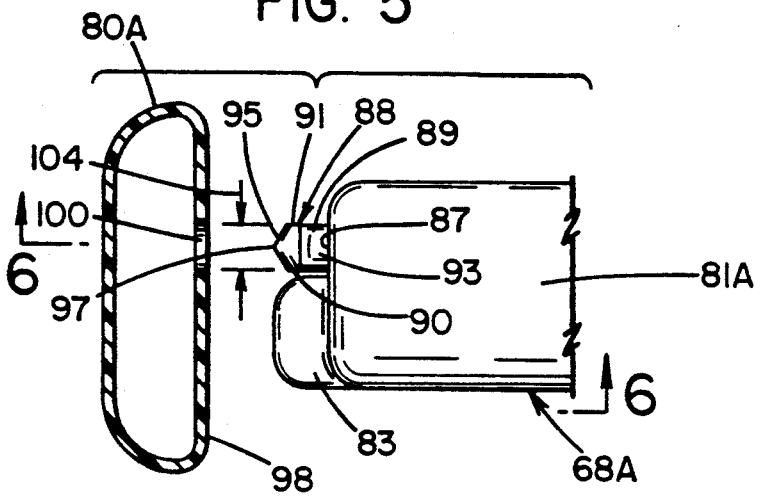
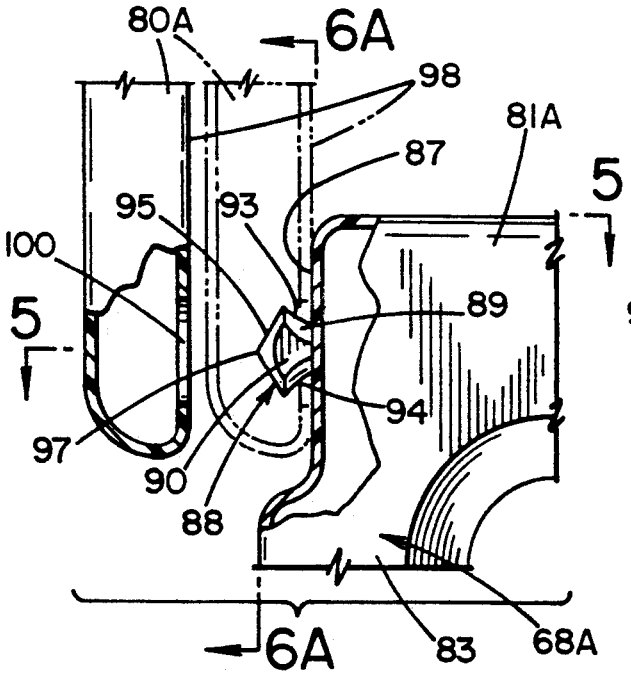
FIG. 6
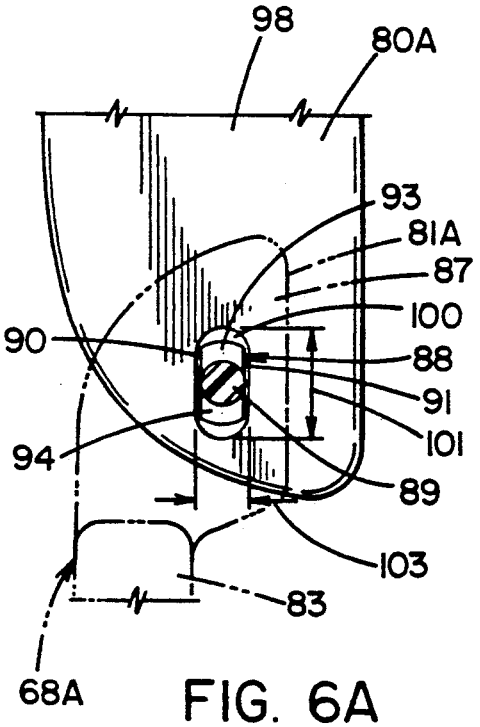
FIG. 6A

FIG. 9
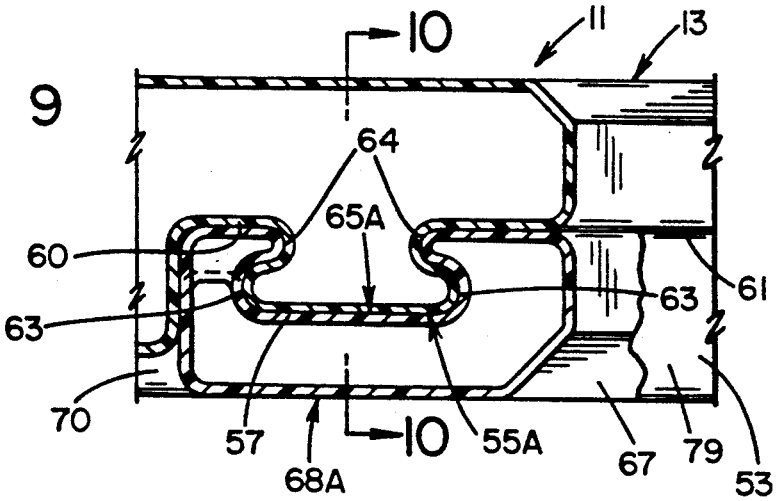
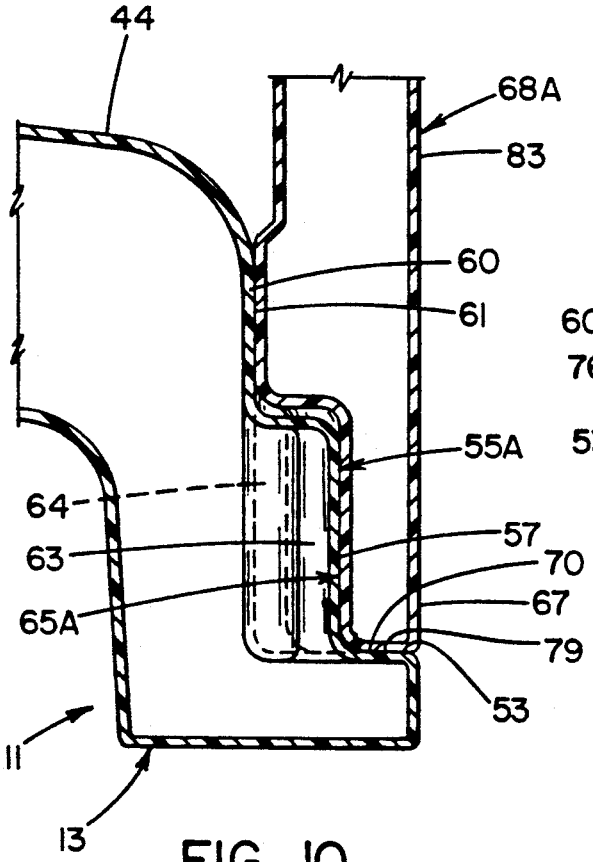
FIG. 10
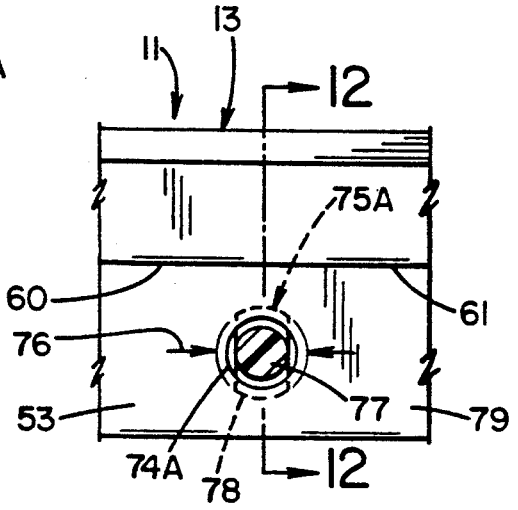
FIG. 11
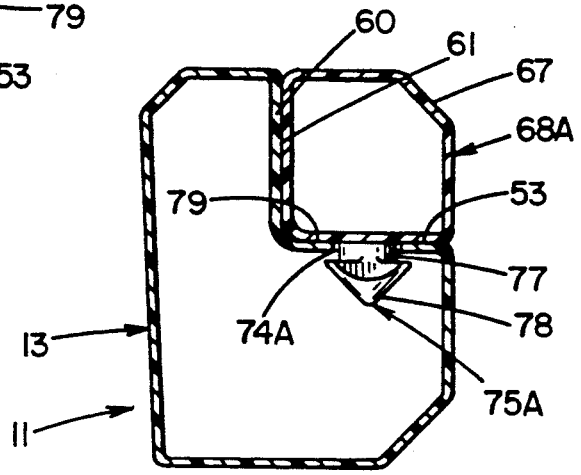
FIG. 12

RIDING TOY FOR CHILDREN

TECHNICAL FIELD

The present invention relates generally to toys for children. More particularly, the present invention relates to riding toys that must be assembled before use. Specifically, the present invention relates to riding toys for children which can be assembled with a minimum number, and variety, of tools to provide a toy having a rigid chassis and side wall construction.

BACKGROUND OF THE INVENTION

Riding toys for children are generally formed as a unitary item or are assembled with threaded fasteners such as bolts and nuts. When such toys are so assembled the fasteners employed are inserted through apertures formed in the structural components of the toy, and the fasteners are tightened to secure the components together. These fasteners must remain tight if the riding toy is to be useful. One alternative solution is to use locking type fasteners in order that the conjoined components will remain rigidly assembled. Such fatseners, however, increase the manufacturing costs of the toy.

Another approach to maintain the desired rigidity is for an adult, or an older child, continually to check for, and tighten, loose fasteners. This option may not always be available. For example, when the child is playing with the toy the loosening of one or more fasteners may go unnoticed, or even if noticed, the necessary tools and a person of sufficient age and experience properly to use the necessary tools may not be readily available. As a result, the child becomes unhappy with the toy, the parents become frustrated and the child ceases to play with the toy.

SUMMARY OF THE INVENTION

It is, therefore, a primary object of the present invention to provide an improved riding toy assembly for children wherein a rigid body assembly is provided.

It is another object of the present invention to provide an improved riding toy assembly, as above, wherein side walls are secured to a chassis by cooperative complementary post and recess structures and cooperating dart and aperture structures.

It is a further object of the present invention to provide a riding toy, as above, wherein the side walls of the toy are interconnected with cross supports by dart and aperture portions.

It is still another object of the present invention to provide a riding toy, as above, wherein the roof dart portions have sloping, cam-like walls which engage the side walls of the apertures, when rotated relative thereto, to provide a locking structure between the cross supports and the side walls.

These and other objects of the invention, as well as the advantages thereof over existing and prior art forms, which will be apparent in view of the following detailed specification, are accomplished by means hereinafter described and claimed.

In general, a children's riding toy embodying the concepts of the present invention will provide a rigid structure which does not need tools for assembly of the basic components. A riding toy incorporating the present invention has a chassis, side walls and roof cross supports. The chassis may be a molded plastic structure having integral mounting posts, or protuberances, and corresponding apertures disposed at spaced locations.

The mounting posts and apertures cooperate with recesses and darts, respectively, which are integrally molded on the side walls. Roof darts are also integrally molded at the upper longitudinal end surfaces of the side walls. The roof cross supports have integrally formed apertures which cooperate with the roof darts to secure the cross supports between the side walls.

The assembly of the body, comprised of the chassis, side walls and roof cross supports, is accomplished without the use of tools. The side walls are laid flat and spaced apart a dimension substantially equal to the space between the apertures in the cross panel. The side walls darts—which are formed integrally on the side walls—have substantially parallel, flat-sided surfaces joined by curved side surfaces. A conical head is presented longitudinally from the side surfaces. The apertures into to which the darts are received have a generally oblong shape one dimension of which is equal to, or slightly greater than, the corresponding width dimension on the dart measured between the flat-sided surfaces at their juncture with the dart head. The roof cross supports can be mounted to the side walls by sliding the apertures over the darts. With both cross supports installed between the side walls, the sub-assembly thus created can be lifted vertically by the cross supports. The side walls will, under the force of gravity, assume a vertical position by rotation of the darts within the apertures. The dimension of the conical head portion of the darts, measured between the curved surfaces of the head portion prevents disengagement of the cross supports from the side walls when disposed in the assembled position depicted in FIGS. 1A, 1B and 4C.

The sub-assembly of the side walls and cross supports is installed on the chassis by aligning the recesses on the posts and pressing downwardly to force the connecting darts on the side walls into respective apertures in the chassis. The posts have tapering, reverse curve, side walls which cooperate with complementary tapering, reverse curve, side walls on the recesses to provide a rigid assembly. When the darts are firmly received within the apertures, the side walls are precluded from moving vertically off the posts.

The chassis has substantially vertically disposed mounting bores for the front axles and horizontally disposed mounting bores for the rear axle. Wheels are mounted on the axles and secured thereto by push-on fasteners. The front axles are secured in the chassis by push-on fasteners. The push-on fasteners are of a well-known type that have tangs which engage the axles and prevent inadvertent removal.

A steering wheel is secured to the chassis by a nut and bolt. The nut is of the locking type which will not loosen unless a tool is used. The steering wheel is the only part of the toy that need a tool for assembly.

The present invention is described in conjunction with one exemplary embodiment of a riding toy for children which is deemed sufficient to effect a full disclosure of the subject invention. The exemplary riding toy is described in detail without attempting to show all of the various forms and modifications in which the invention might be embodied; the invention being measured by the appended claims and not by the details of the specification.

BRIEF DESCRIPTION OF THE DRAWINGS

FIG. 5 is a further enlarged view taken substantially along line 5—5 of FIG. 6;

FIG. 6 is a progressive assembly view, the solid line portion having been taken substantially along line 6—6 of FIG. 5, the chain line portion depicting how the cross support is translated into engagement with a side wall;

FIG. 6A is a view taken substantially along line 6A—6A in FIG. 6 and depicting the dart on a side wall removably disposed within the receiving aperture in the cross support;

FIG. 9 is an enlarged, horizontal section taken substantially along line 9—9 in FIG. 2;

FIG. 10 is a vertical section taken substantially along line 10—10 of FIG. 9;

FIG. 11 is an enlarged, horizontal section taken substantially along line 11—11 of FIG. 2; and, FIG. 12 is a vertical section taken substantially along line 12—12 of FIG. 11.

DESCRIPTION OF AN EXEMPLARY EMBODIMENT

Figure 1A:
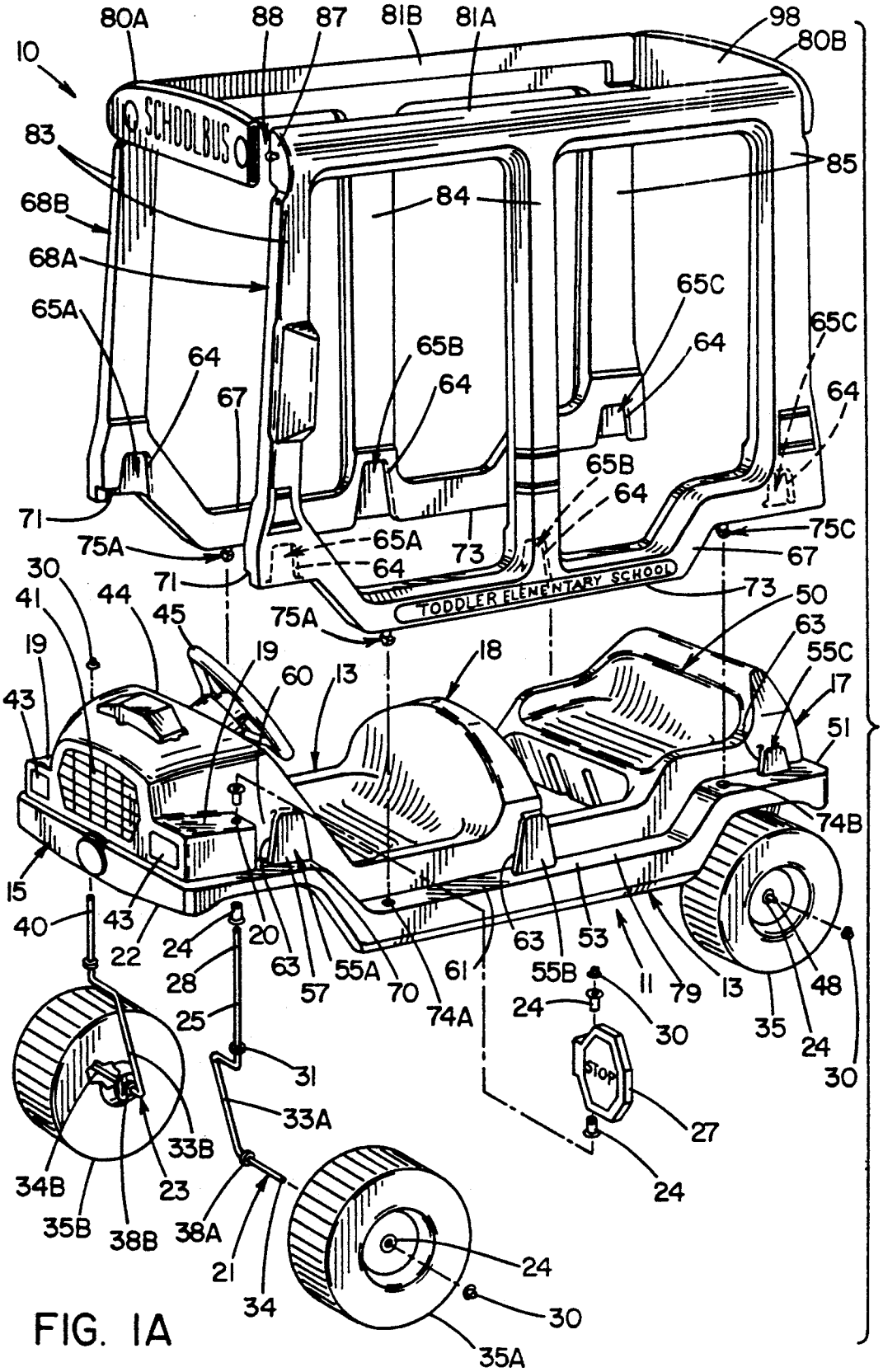
FIG. 1A is an exploded perspective view of a riding toy embodying the concepts of the present invention.
Figure 1B:
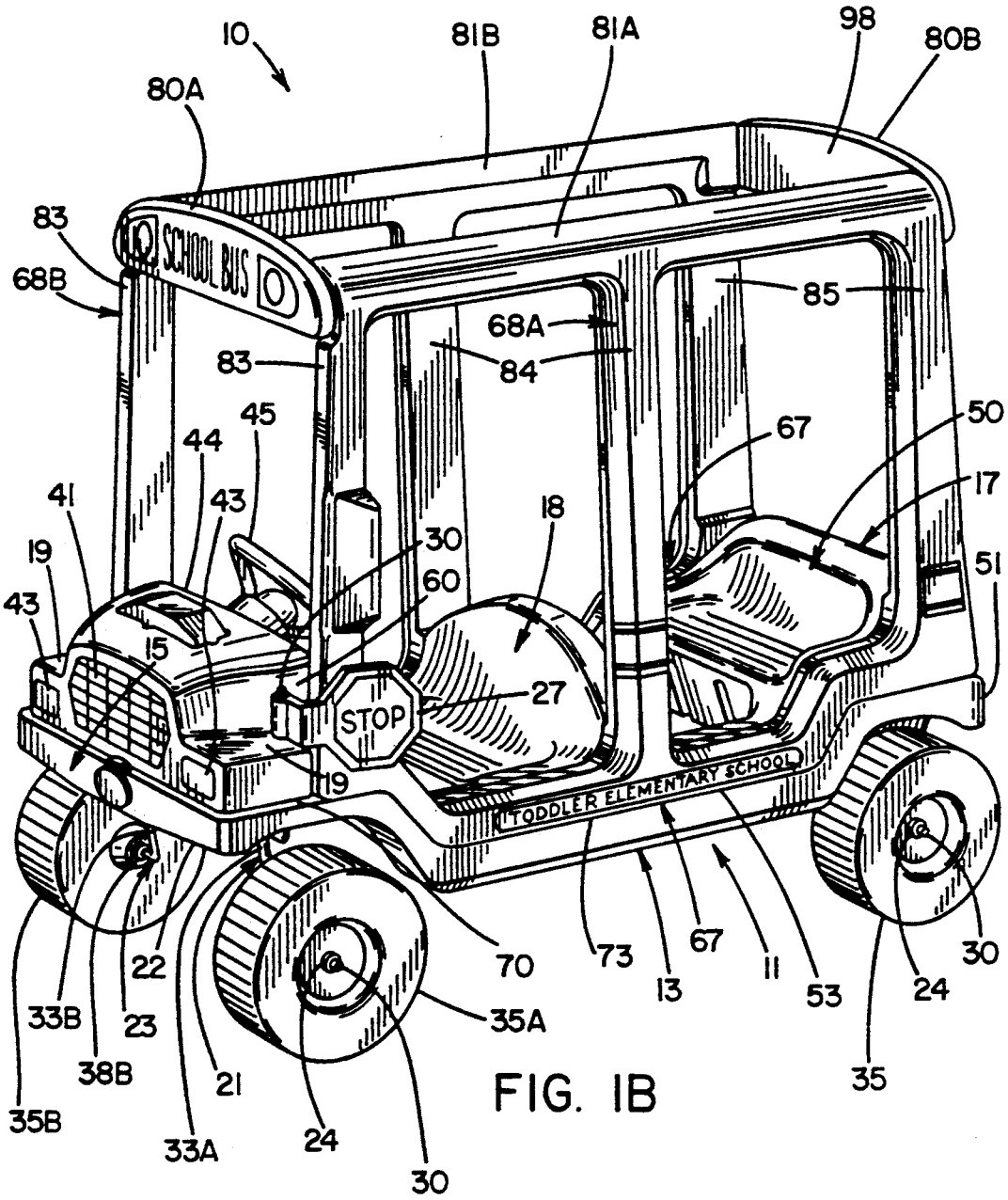
FIG. 1B is a perspective view of the riding toy depicted in FIG. 1A, as assembled.

Referring to the drawings, wherein like characters represent the same or corresponding parts throughout the several views, an exploded perspective view of a riding toy, or vehicle, 10 embodying the concepts of the present invention is depicted in FIG. 1A. A perspective view of the riding toy 10, as assembled, is shown in FIG. 1B. The riding toy 10 is supported on a chassis 11 having spaced side rails 13 that extend longitudinally of the toy 10, and parallel to the longitudinal axis 14 thereof. The chassis 11 may be formed from plastic material that is molded in one or more pieces. If the chassis 11 is molded in two components, the separate pieces will be bonded together by conventional bonding methods such as sonic or chemical welding. The side rails 13 are joined by a front axle tie bar, or bumper, 15, a rear axle tie bar 17 and a front seat support, 18. The front axle tie bar 15 has substantially vertically opening apertures 20 formed in upper and lower surfaces 19 and 22 to provide vertically orientation of front axles 21 and 23. The front axles 21 and 23 are rotatably supported in bushings 24 which are fitted, with a light press fit, in the apertures 20. For convenience the assembly 10 preferably uses the same size bushing 24 at all locations where the bushings 24 are required to support rotary motion.

Figure 3:
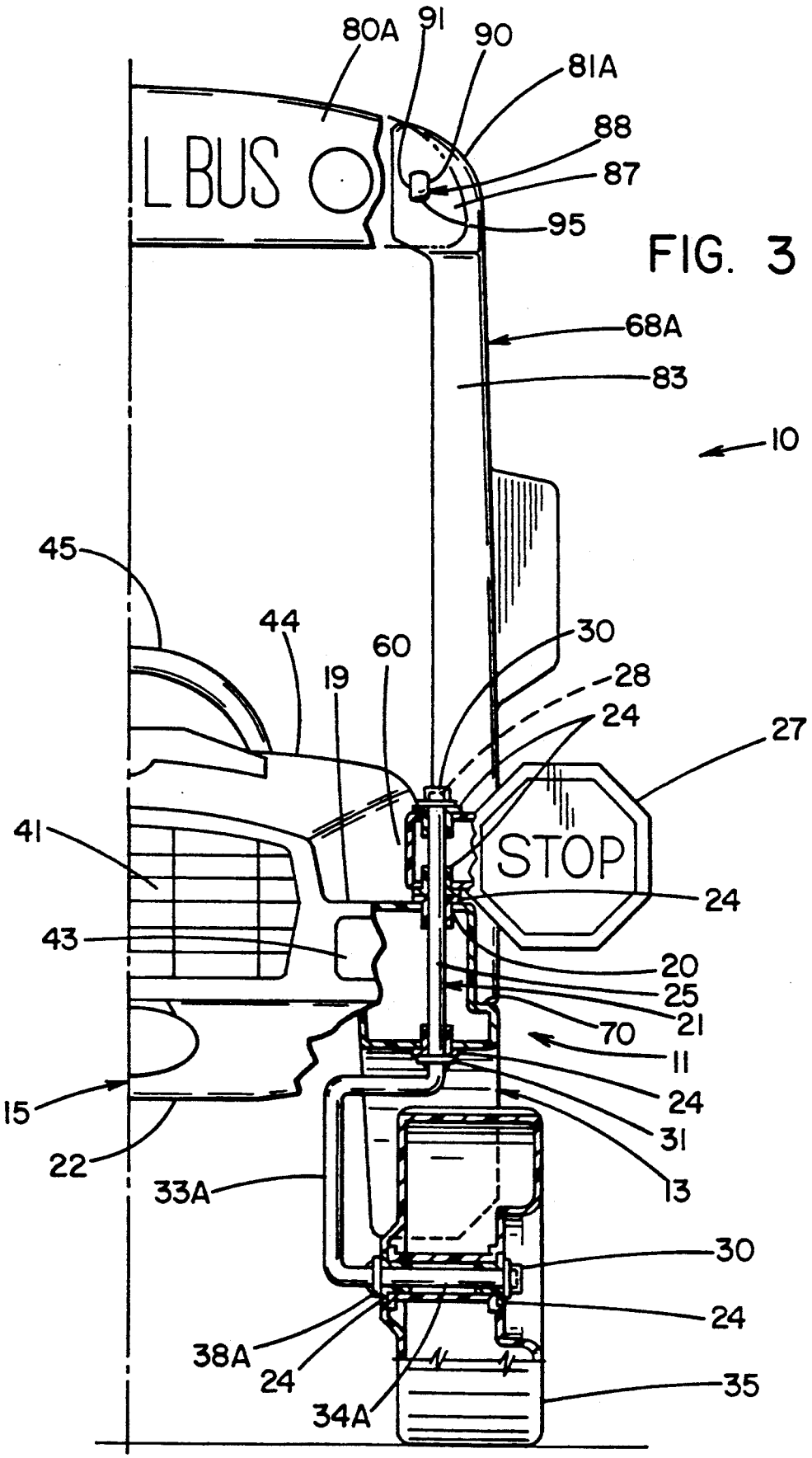
FIG. 3 is a front elevational view, also partly broken away, of a portion of the front of the riding toy, and also assembled as represented in FIG. 1B.

The front axle 21 has a vertical rod portion 25 which is supported in a pair of the bushings 24. The uppermost end of the rod portion 25 may rotatably support a sign 27 such as the "stop" sign depicted. The sign 27 is also preferably supported on bushings 24. The upper end 28 of the rod portion 25 on the front axle 21 is securely fastened in location with a push-on fastener 30. A locating shoulder 31 is formed adjacent the lower end of rod portion 25 to position the axle 21 in the apertures 20 and bushings 24. The axle 21, as best seen in FIG. 3, has a U-shaped portion 33A which terminates at the lower end thereof in a wheel support axle portion 34A.

Axle 23 is similar in construction to axle 21 and also presents a U-shaped portion 33B and a wheel support axle portion 34B. The axle portions 34 support wheels 35 which are rotatably mounted on the axle portions 34 through the cooperation of bushings 24 and are secured in place by push-on fasteners 30.

As previewed in the previous two paragraphs, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two, virtually identical, wheel support portions which are generally identified by the numeral 34, but the specific, individual wheel support portions are, therefore, identified as 34A and 34B in the specification and on the drawings. This same suffix convention shall be employed throughout the specification.

Each axle portion 34 has an inner locating shoulder 38 which determines the innermost position of each wheel 35. As seen in FIG. 3, the shoulder 38A is positioned to maintain clearance between the wheel 35A and the U-shaped portion 33A. The construction of the axle 23, and the support of wheel 35B thereon, is similar to the construction of the axle 21 which is shown in FIG. 3 with the exception that the axle 23 has a shorter upper rod portion 40 which is secured in respective bushing 24 and apertures 20 by a push-on fastener 30.

Figure 2:
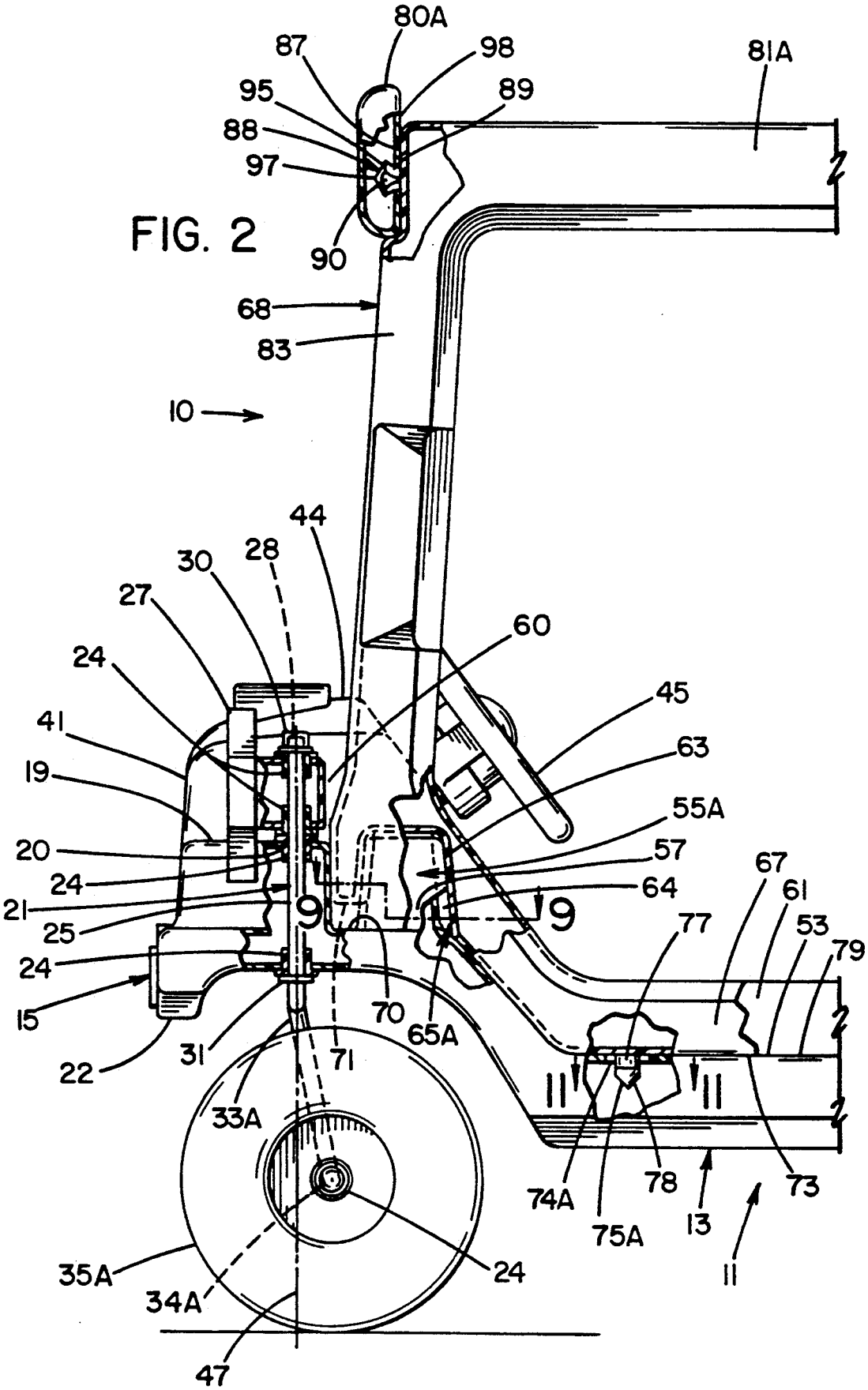
FIG. 2 is an enlarged, side elevational view, partly broken away, of a front portion of the riding toy, assembled as represented in FIG. 1B.

The front axle tie bar 15 may present a front grille portion 41 and headlights 43. The front tie bar 15 also provides a support 44 for a steering wheel assembly 45. The steering wheel assembly 45 is mounted to the support 44 by a conventional, threaded fastener and locking nut, not shown. As seen in FIG. 2, the U-shaped portion 33A of the axle 21 is skewed, or angled, rearwardly from the vertical plane 47 which defines the longitudinal orientation of the rod 25. The axle 23 has a substantially identical orientation. This rearward slant of the U-shaped portion 33 provides a positive caster for the axles 21 and 23 such that, when the vehicle 10 is moving forwardly, the wheels 35A and 35B will track correctly. That is, the forward movement of the vehicle 10 acting against the caster of the axles 21 and 23 will align the wheels 35 with the direction of motion. This castering function of the axles 21 and 23 will cause the front wheels 35 to steer to the direction in which the driver moves the vehicle. The axles 21 and 23 will rotate about their respective rod portions 25 and 40 as a result of the forces imposed on the axles 21 and 23 by the driver of the vehicle.

The use of a caster angle to obtain self-steering is well known. If the driver moves the vehicle rearwardly, the wheels 35 will assume a position such that the U-shaped portion 33 of the axles 21 and 23 will be skewed toward the front of the vehicle, thus achieving positive rearward caster. The steering wheel assembly 45 does not function to steer the vehicle. This relieves the driver of coordinating movement between the hand and feet when attempting to steer. If desired, the rod portions 25 and 40 can also be skewed slightly from vertical, when viewed from the front, to provide a camber angle. Generally the camber angle will compensate for the weight of the passengers by permitting some deflection at the U-shaped portions 33 to accommodate an alignment more close to vertical. Camber angle will also cooperate with the caster angle to assist in steering the vehicle.

The rear axle tie bar, or rear bumper, 17 also has spaced apertures, not shown, in which bushings 24 are received to support an axle 48 which in turn supports rear wheel 35. The rear wheels 35 are rotatably supported on bushings 24 similar to those used by the front wheels 35 and are prevented from leaving the axle 48 by push-on fasteners 30. The rear axle tie bar 17 provides a rear seat support 50 and a rear cross member support portion 51.

The side rails 13 are also interconnected by the integral front seat support 18 which defines a bench on which the front seat driver can be seated while the rear seat passenger can be seated on a bench structure defined by the rear seat support 50. The structure of the side rails 13, front axle tie bar 15, rear axle tie bar 17 and the front seat support 18 may be integrally molded to provide a rigid frame structure for the chassis 11. Even when the chassis 11 is molded in two parts, the upper and lower halves of the frame structure are preferably molded as integral structures which are then bonded into a singular structure.

The side rails 13 of the chassis 11 have a substantially flat support platform 53 which extends fore and aft of the vehicle. The support platform 53 has upwardly extending therefrom a plurality of support protuberances 55 which are formed integrally with the front axle tie bar 15, the front seat support 18 and the rear axle tie bar 17. The support protuberances 55 are substantially trapezoidal in shape with the large base 57 formed integrally with the platform 53. Support protuberance 55A on the front axle tie bar is shown in FIGS. 9 and 10. The protuberances 55B and 55C are integral with the front seat support 18 and the rear axle tie bar 17.

As best seen in FIGS. 9 and 10, the side wall 60 of the tie bar 15 is hollow. The protuberance 55A is formed on the outer wall surface 61, as are the protuberances 55B and 55C. The opposite side of the tie bar 15 and the chassis 11 is identical in construction. Thus, it is believed that only a detailed description of the left side (driver's side) of the riding toy will be necessary to provide a full description of the present invention. The protuberance 55A has reverse curve or S-shaped side wall portions 63 between the outer surface of each protuberance 55 and the side wall 60. The protuberances 55 cooperate with complementary reverse curve side wall portions 64 which are formed in locating recesses 65. The recesses 65 are formed in a side rail 67 of a vehicle side wall 68. As seen in FIGS. 1 and 4C, the riding toy has two side walls 68A and 68B which are mirror images. Each of these side walls 68 has a side rail 67 in which the recesses 65 are formed. As best seen in FIG. 1, the recesses 65 are to be aligned with respective protuberances 55 during assembly.

The complementary shape of the protuberance 55 and 65 provide a rigid connection between the side walls 68 and the chassis 11, and thereby restrain fore and aft movement of the side wall 68A relative to the chassis 11. The tapering side walls of the support 55 and recess 65 operate as a wedge structure such that, as the side walls 68 are pressed into position on the chassis 11, significant interlocking forces are created between these members. The molded material is somewhat pliable to permit the surfaces of the recess 65 and the support 55 to compress slightly, thus establishing a rigid and stable connection. The protuberance 55A has a lower shelf portion 70 which supports a step 71 formed in the recess 65A of the side wall 68. This provides one vertical support surface for the side wall 68. A second vertical platform is provided at a lower edge 73 of the side rail 67 which abuts the platform 53. The protuberances 55B, disposed adjacent the front seat support 18, and the protuberance 55C, disposed adjacent the rear tie bar 17, are similar in construction to that of the protuberance 55A. The protuberance 55B, however, has sightly more length than either protuberance 55A or 55C, and the mating recesses 65B and 65C do not include a shelf portion equivalent to that which is present on protuberance 55A. Likewise, the recesses 65B and 65C do not include shoulders equivalent to the shoulder 71 formed in the recess 65A.

The platform 53 presents a pair of apertures 74 which are spaced along the side rail 13. Aperture 74A is located at substantially the forward portion of the chassis 11 adjacent the front axle tie bar 15, whereas the aperture 74B is located adjacent the rear axle tie bar 17. A plurality of connecting darts 75 are formed on the side walls 68. Each wall dart 75 has a substantially cylindrical stem portion 77 and conical end or head portion 78. The conical head portion 78 has a base diameter 76 which is larger than the diameter of the aperture 74. The conical end portion is inserted through the aperture 74 at assembly such that the aperture 74 will expand to accept the conical head portion 78 and then contract about the stem 77. With this structure the conical end portion 78 will firmly retain the side rail 67 in abutment with the platform 53. The forces generated between the complementary surfaces 63 and 64 will maintain the base 76 of the conical head portion 78 solidly in contact with the lower surface 79 of the platform 53. This structure will firmly connect the side walls 68 to the chassis 11.

Figure 4A:
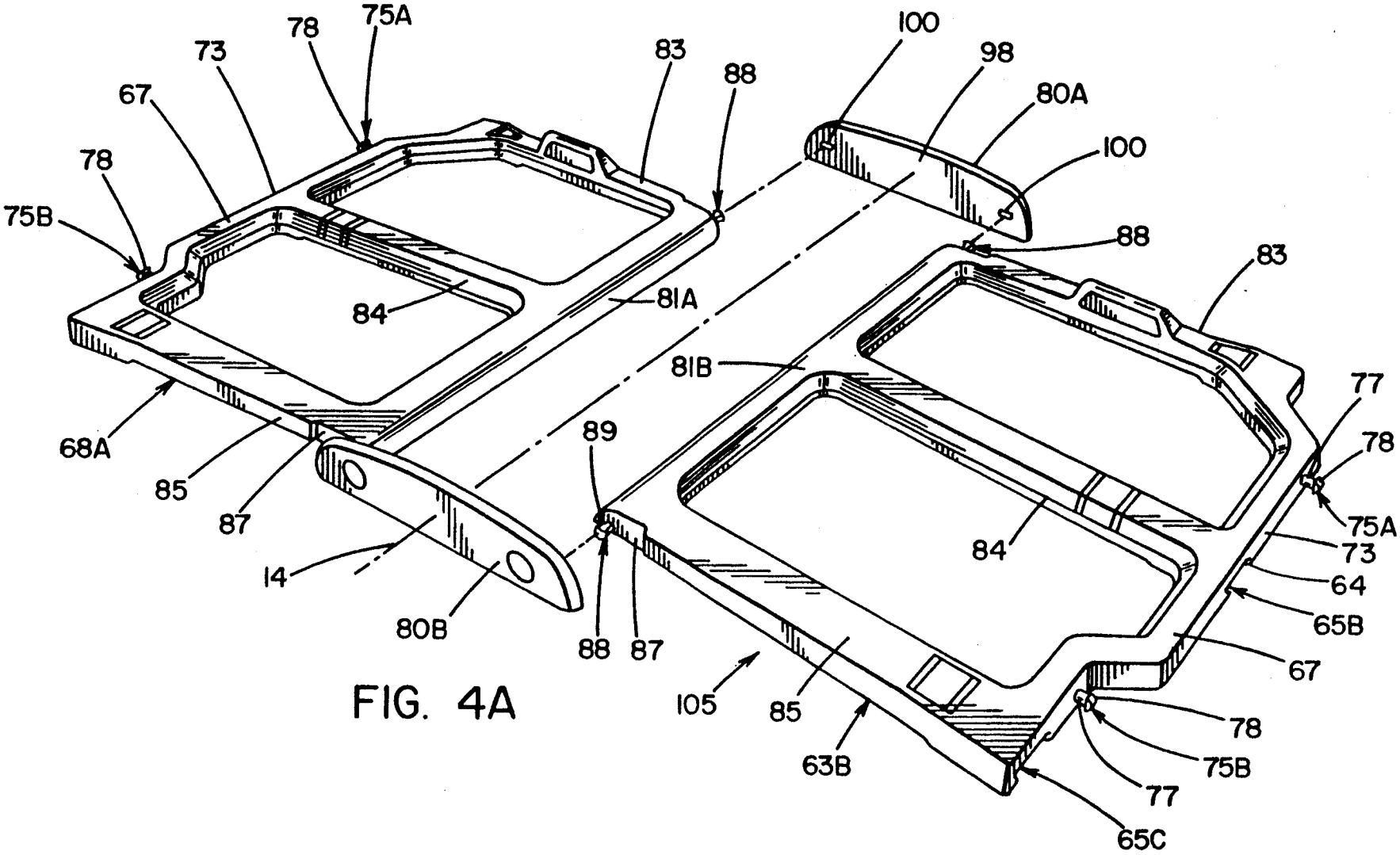
FIG. 4A is an exploded perspective view of the side walls and roof cross supports in a butterfly position for assembly.
Figure 4B:
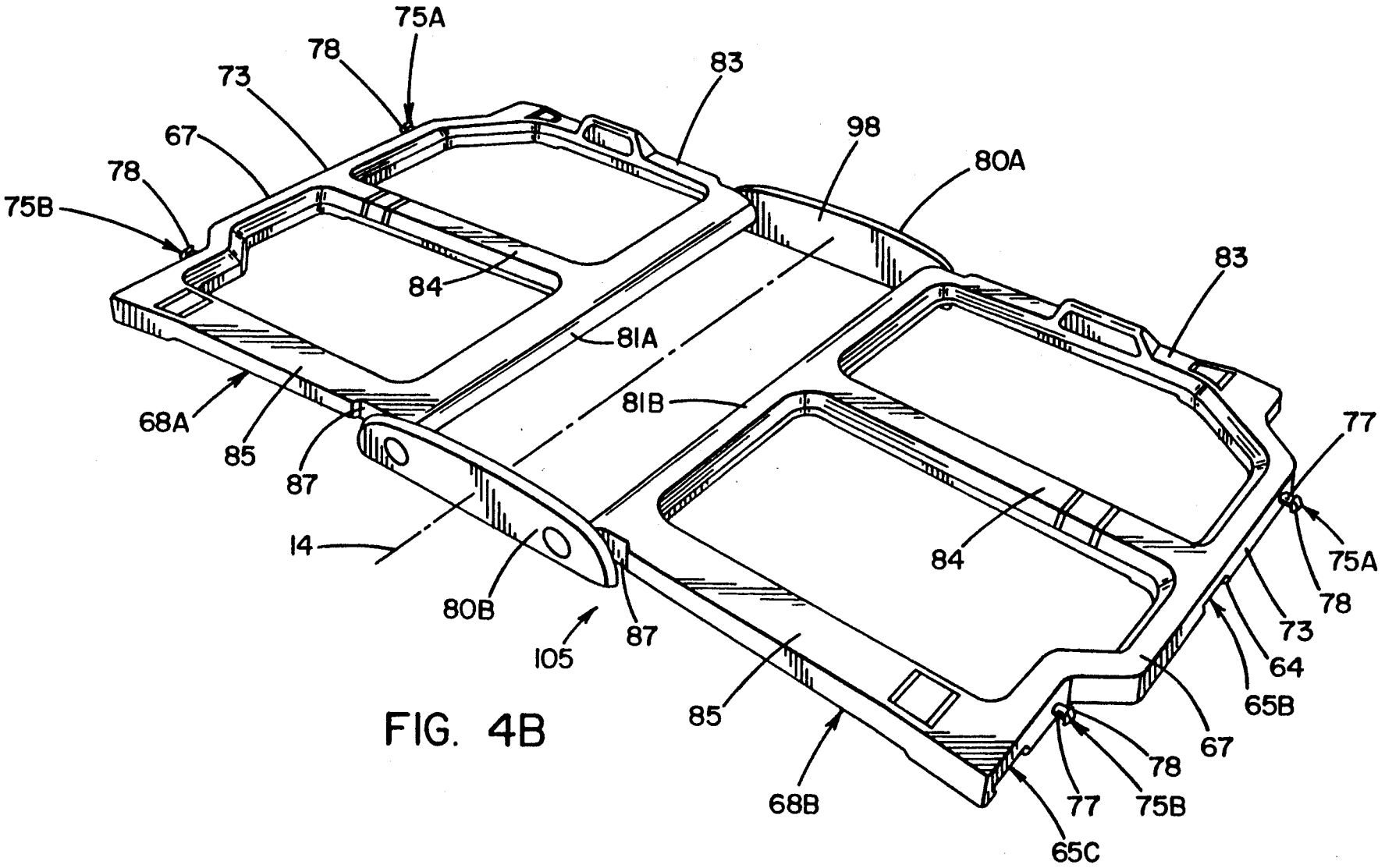
FIG. 4B is a perspective view of the side walls and roof cross supports depicted in FIG. 4A which have been assembled but which are still disposed in a substantially planar, horizontal orientation.
Figure 4C:
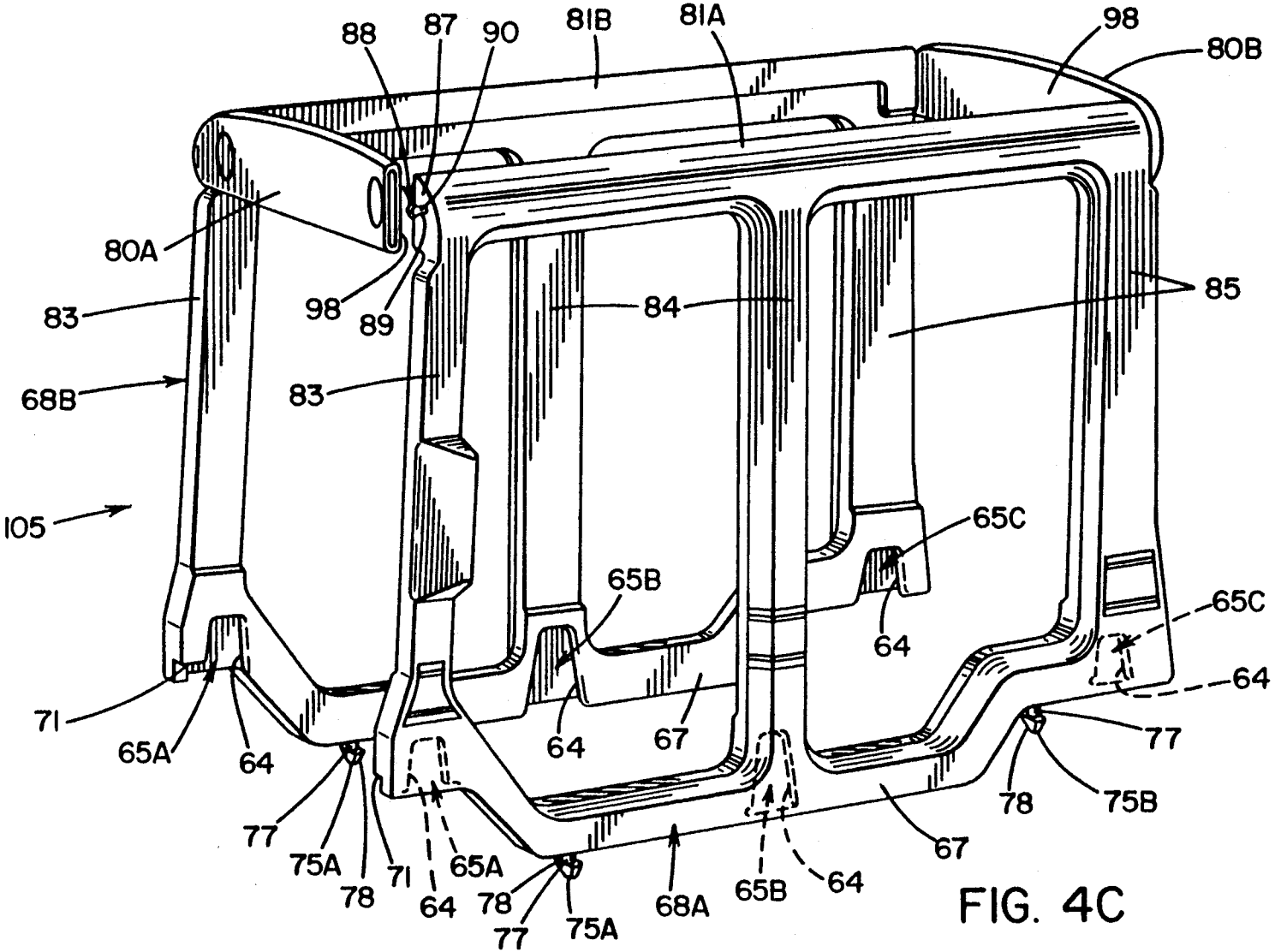
FIG. 4C is a perspective view of the side walls and roof cross supports, assembled as represented in FIG. 4B, but with the side walls disposed in vertical orientation relative to the cross supports and thereby locked in preparation for mounting onto the chassis.

As best seen in FIGS. 4A through 4C, the riding toy 10 has the spaced side wall 68 interconnected at an upper or roof rail 81 by cross members, or supports, 80. Cross member 80A interconnects the front ends of the side wall 68 and the cross member 80B interconnects the rear ends of the side walls 68. Each side wall 68 has the lower side rail 67 and the roof rail 81. The rails 67 and 81 are secured integrally with a front vertical rail 83, a center vertical rail 84 and a rear vertical rail 85. Each of the side wall 68 may be an integrally molded component which may, as previously described for the chassis 11, be molded in two components which are then bonded together. The juncture of the front rail 83 and the roof rail 81 form a planar surface 87 from which a roof dart 88 is presented. As best seen in FIGS. 5 and 6, the roof dart 88 has a stem portion 89 which is formed with flat side wall portions 90 and 91, extending outwardly from the planar surface 87, and curved side walls 93 and 94, diverging outwardly from the surface 87 to intersect with a conical head portion 95 which presents a converging end 97 for the dart 88.

Figure 7:
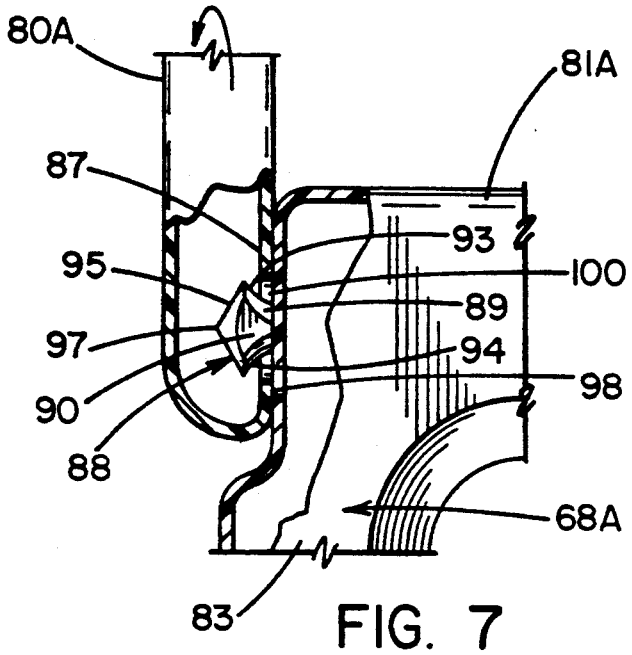
FIG. 7 is a view similar to FIG. 6 with the dart on the side wall having been inserted within the receiving aperture.
Figure 8:
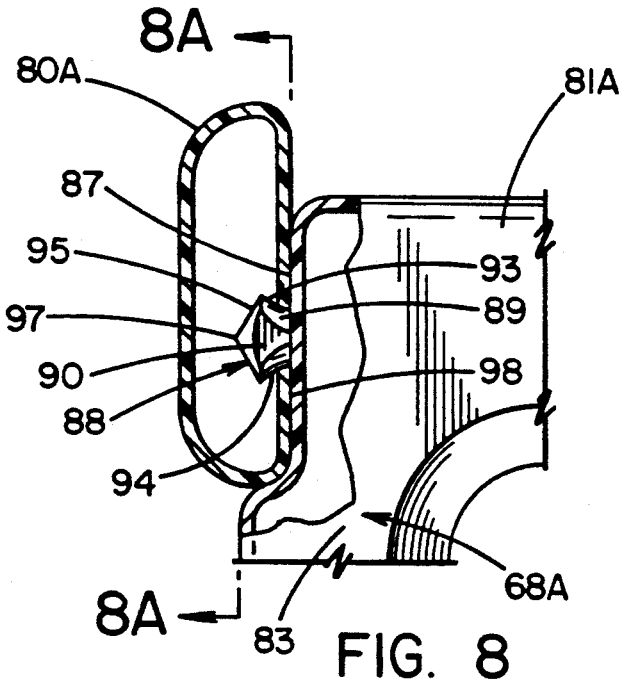
FIG. 8 is a view similar to FIG. 7, but with the side wall and the cross support having been relatively rotated (in the direction of the arrow in FIG. 7) to effect the locking assembly of those components, as represented in one of the broken away portions of FIG. 2.
Figure 8A:
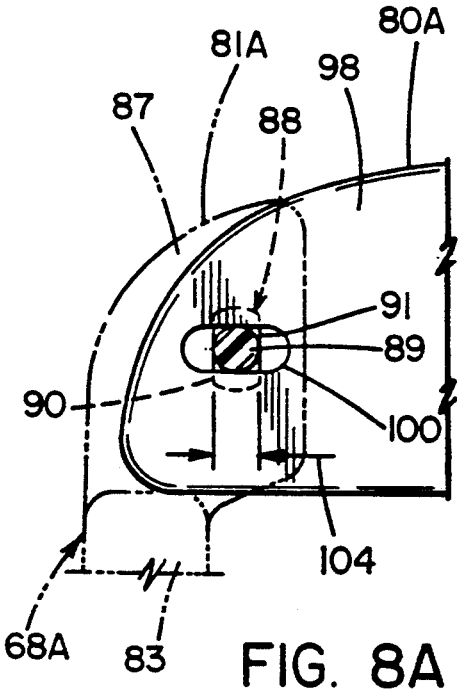
FIG. 8A is a view taken substantially along line 8A—8A in FIG. 8 and depicting the dart on a side wall lockingly disposed within the receiving aperture in the cross support.

The cross members 80 have an inner flat wall 98 which is pierced at two locations 100 to form apertures in which the roof darts 88 are inserted. As best seen in FIG. 4A, the assembly is accomplished by laying the side rails 68 flat on a surface such as a floor and inserting the darts 88 into the apertures 100 of the cross members 80. The apertures 100 have a length dimension 101 which is greater than the width dimension 103, thus providing an oblong, or oval, shape to the apertures 100. The width dimension 103 is equal to, or slightly greater than, the dimension 104 between the flat side wall portions 90 and 91 of dart 88. Thus, as seen in FIG. 7, the darts 88 will slide into, or are easily inserted through, the apertures 100 when the cross members 80 and side wall 68 are positioned as shown in FIG. 4A. This facilitates assembly of the side wall 68 and cross members 80 to establish the side wall and roof sub-assembly 105 shown in FIG. 4B.

When the sub-assembly 105 has been constructed, as shown in FIG. 4B, the sub-assembly 105 can be grasped by the cross members 80 and lifted. This will permit the side walls 68 to pivot about the roof darts 88 for the sub-assembly 105 to assume the position shown in FIG. 4C. In this position of sub-assembly 105, the curved side walls 93 and 94 will be disposed in the width dimension 103. Because the curved side walls 93 and 94 require more space than present at the width 103, an interference fit will occur between the apertures 100 and the roof darts 88. The plastic from which the cross member 80 and darts 88 are molded will have sufficient ductility to permit deformation to ensure that a secure connection is accomplished. However, the sub-assembly 105 can, if desired, be disassembled by rotating the side walls 68 to the position shown in FIG. 4B. The ductility of the plastic material prevent the components from taking a permanent set and thus, will permit the components to return to their original dimensions, if disassembled.

The sub-assembly 105 comprised of the side walls 68 and cross supports 80 is positioned on the chassis 11 such that the recesses 65 of the side walls 68 are aligned with respective support protuberances 55 on the chassis 11, and the darts 75 are aligned with respective apertures 74. The sub-assembly 105 can then be connected to the chassis 11 by applying sufficient downward force such that the conical head portion 78 of each dart 75 will penetrate the apertures 74 to assume the assembled position shown in FIGS. 1-3 and 9-12. When the conical ends of the darts 75 are in abutment with the surface 79, the sub-assembly 105 and the chassis 11 will form a rigid assembly that is not susceptible to loosening while in use.

The entire vehicle, or riding toy, 10 is assembled with a minimum of tools. The only threaded fastener required in the assembly is used to secure the steering assembly 45 to the chassis 11. The axle assemblies are assembled to the chassis with push-on fasteners 30. These fasteners 30 can be assembled by hand without a tool. However, a hollow, tubular member can be used to push the fasteners 30 onto the ends of the axles, if desired. Once the fasteners 30 are installed, the wheels 35 and axles 21, 23 and 48 are secured to the vehicle with sufficient permanence that loosening under use will not occur. As is well known, the push-on type fasteners 30 will pierce the surface of the mating component to discourage reverse movement of the fasteners 30.

It should be appreciated from the foregoing discussion that the taper of the recesses 65 and the taper of the support protuberances 55, as well as the reverse curve configuration of their respective side walls, cooperate to prevent relative fore and aft movement at these junctures while the darts 75 and apertures 74 cooperate to provide a rigid, vertical attachment which inhibits relative vertical movement between the chassis 11 and sub-assembly 105. The spaced location of the recesses 65, the protuberances 55, the darts 75 and apertures 74 as well as the camming interaction between the mating components assure that the riding toy will remain a rigid assembly during extended use.

The support protuberances 55 and recesses 65 are specifically designed not to be straight sided members. The taper and reverse curvature of the side 63 and 64 also assist in the rigidity of the assembly in both transverse and longitudinal directions.

The roof darts 88 with the curved side walls 93 and 94 cooperate with the oblong apertures 100 to establish a stiff transvevrse and longitudinal structure in the sub-assembly 105. The overall combination of the attachment means utilized in the sub-assembly 105 and the vehicle 10 establish a serviceable toy without the need for threaded fasteners which are expensive and can become lost between unpackaging and assembly. The opportunity for the fasteners to be omitted at the packaging source is also eliminated. The integral molding of the attachment and securement means also provides an economic advantage.

The foregoing description of the exemplary embodiment of the invention has been presented for the purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches that a riding toy for children embodying the concepts of the present invention not only provides a rigid body assembly but also accomplishes the other objects of the invention.

I claim:

1. A riding toy comprising:

an integral chassis having, a longitudinal axis, a pair of spaced side rails extending substantially parallel with the longitudinal axis, front axle tie bar means formed integrally with an extending laterally between the side rails for interconnecting said side rails and providing spaced front lateral spaced vertically extending axle support means, rear axle tie bar means formed integrally with and extending laterally between said side rails for providing rear lateral axle support means, front seat support means formed integral with and extending between said side rails intermediate said front and rear lateral axle tie bar means, rear seat means formed integral with said rear tie bar means and said side rails;

each said side rails has spaced side wall support means formed integral with each said front tie bar means, said front seat support means and said rear tie bar means, a longitudinally extending side wall support platform and spaced side wall attaching means;

a pair of side wall means, each of which having chassis support rail means for supporting the side wall means on the side wall support platform, locating means formed integral with the side rail means and being complementary with the side wall support means on respective ones of said side rails for locating said side wall means thereon, first dart means for engaging said side wall attaching means for securing said side wall means with respective ones of said side rails, roof rail means defining the upper extend of the side wall means and support struts formed integral with and extending between said chassis support rail means and said roof rail means in substantial alignment with the locating means, and second dart means extending form respective ends of the roof rail means;

a pair of support panel means, each of support panel means having attaching means formed integrally therewith for cooperating with said second dart means for securing the support panel means with said side wall means and for providing upper transverse support for said side wall means; and, wheel and axle means disposed in said front and rear axle tie bar means for supporting the riding toy on a surface.

2. A riding toy, as set froth in claim 1, wherein the side wall support means each comprise:

an outer surface;

tapered side walls formed of reverse curve surfaces integrally joining the outer surface and the side wall.

3. A riding toy, as set forth in claim 2 wherein the locating means each comprise:

a recess having tapered reverse curve side walls complementary to the reverse curve surfaces of the side wall support means.

4. A riding toy, as set forth in claim 1, wherein:

said second dart means has a stem portion defined by spaced parallel side portions interconnected by curving side walls; and, an integral conical head portion presented from the parallel side portions and the curving side walls.

5. A riding toy, as set forth in claim 4, wherein said attaching means comprises:

an aperture having a width dimension less than a length dimension; and, said second dart means has a dimension between the parallel side portions substantially equal to the width dimension, and a dimension between said curved side walls being greater than the width dimension.

6. A riding toy, as set forth in claim 5, wherein:

said second dart means has a stem portion defined by spaced parallel side portions interconnected by curving side walls and an integral conical head portion presented from the parallel side portions and the curving side walls.

7. A riding toy, as set forth in claim 6, wherein said attaching means comprises:

an aperture having a width dimension less than a length dimension; and, said second dart means has a dimension between the parallel side portions substantially equal to the width dimension, and a dimension between said curved side walls being greater than the width dimension.

8. A riding toy comprising:

a chassis portion having a plurality of connecting and support means each defining a protuberance means presented from a side rail and including tapered side walls each defining a reverse curve surface between the side rail and an outer surface of the protuberance;

seating means presented from said chassis portion;

means to support said chassis portion above a ground reference and allow said chassis to move thereacross;

a pair of side wall means having a plurality of locating recesses engaging respective ones of said protuberance means rigidly to secure the side wall means with said chassis; and, said locating recesses including tapered reverse curve side portion mating with the side walls.

9. A riding toy, as set forth in claim 8 further comprising:

a pair of support panel means each of which has attaching means formed integrally therewith for cooperating with dart means formed on an upper end of each said side wall means for securing the support panel means with said side wall means for providing upper transverse support for said side wall means.

10. A riding toy, as set forth in claim 9, wherein:

said dart means has a stem portion defined by spaced parallel side portions interconnected by curving side walls and an integral conical head portion presented from the parallel side portions and the curving side walls.

11. A riding toy, as set forth in claim 10, wherein said attaching means comprises:

an aperture having a width dimension less than a length dimension and said dart means has a dimension between the parallel side portions substantially equal to the width dimension, and a dimension between said curved side walls being greater than the width dimension.

* * * * *